US012601507B2

(12) United States Patent
Deivasigamani et al.

(10) Patent No.: US 12,601,507 B2
(45) Date of Patent: Apr. 14, 2026

(54) THERMAL BATTERY HEAT TRANSFER COIL

(71) Applicant: Intellihot, Inc., Galesburg, IL (US)

(72) Inventors: Sridhar Deivasigamani, Mundelein, IL (US); Sivaprasad Akasam, Round Rock, TX (US)

(73) Assignee: Intellihot, Inc., Galesburg, IL (US)

( * ) Notice: Subject to any disclaimer, the term of this patent is extended or adjusted under 35 U.S.C. 154(b) by 385 days.

(21) Appl. No.: 18/206,064

(22) Filed: Jun. 5, 2023

(65) Prior Publication Data

US 2024/0401818 A1 Dec. 5, 2024

(51) Int. Cl.

| | |
|---|---|
| ***F24D 17/00*** | (2022.01) |
| ***F24D 17/02*** | (2006.01) |
| ***F28D 20/00*** | (2006.01) |
| ***F28F 9/26*** | (2006.01) |
| ***F28F 21/08*** | (2006.01) |

(52) U.S. Cl.

CPC ..... *F24D 17/0026* (2013.01); *F24D 17/02* (2013.01); *F28D 20/0034* (2013.01); *F28F 21/083* (2013.01); *F24D 2200/12* (2013.01); *F28F 9/264* (2013.01)

(58) Field of Classification Search

CPC .. F24D 17/0026; F24D 17/02; F24D 2200/12; F28F 21/083; F28F 9/264; F28D 20/0034; H05B 3/78

USPC ..... 165/10

See application file for complete search history.

(56) References Cited

U.S. PATENT DOCUMENTS

| | | | | | |
|---|---|---|---|---|---|
| 4,357,910 | A * | 11/1982 | Blockley | F24H 1/43 | 165/163 |
| 4,602,145 | A * | 7/1986 | Roberts | A47J 31/56 | 99/305 |
| 6,574,426 | B1 * | 6/2003 | Blanco, Jr. | F24H 1/102 | 392/485 |
| 8,909,033 | B2 * | 12/2014 | Kreutzman | F24H 9/2021 | 392/458 |
| 2010/0018246 | A1 * | 1/2010 | Wolfe, IV | F28D 7/022 | 165/154 |
| 2021/0041143 | A1 * | 2/2021 | Diederiks | F24D 17/02 | |
| 2021/0199389 | A1 * | 7/2021 | Helppolainen | F28F 21/083 | |

FOREIGN PATENT DOCUMENTS

| | | | | |
|---|---|---|---|---|
| CN | 207235435 U | * | 4/2018 | |
| CN | 109539691 A | * | 3/2019 | F25D 31/002 |
| KR | 20240176354 A | * | 12/2024 | B23P 15/26 |

* cited by examiner

*Primary Examiner* — Jon T. Schermerhorn, Jr.

(74) *Attorney, Agent, or Firm* — Jong Patent Firm; Cheng Ning Jong; Tracy P. Jong

(57) ABSTRACT

A thermal battery including a container including an interior space configured for receiving a heat transfer fluid; and a coil disposed in the interior space of the container, the coil comprising an inlet end and an outlet end, wherein at least one of the inlet end of the coil and the outlet end of the coil is configured to be movably disposed with respect to the container through at least one aperture of the container, wherein one of an expansion and a contraction of the coil is accommodated by allowing movement of the coil relative to the container.

20 Claims, 4 Drawing Sheets

THERMAL BATTERY HEAT TRANSFER COIL

BACKGROUND OF THE INVENTION

1. The Field of the Invention

The present invention relates to a thermal battery. More specifically, the present invention is directed to an arrangement of a heat transfer coil of a thermal battery in relation to a container of a thermal battery which optimizes charging and discharging of the thermal battery.

2. Background Art

Various fossil fuel phase-out initiatives have been made in the heating industry and mandates have been increasingly devised and implemented to phase out the direct or indirect use of fossil fuel in heat production for domestic and/or industrial uses.

Attempts have been made to heat domestic water with alternative means, e.g., with the use of heat pumps having operations that are primarily driven using electricity in the form of pump or compressor operations. Supplemental electric, e.g., resistive heating elements may also be employed to aid fossil fuel-free domestic water heating systems in meeting heating demands. A thermal battery may be charged using one or more heat pumps and electric heating elements. However, as much as possible, for an energy efficient operation, the thermal battery shall be charged with a heating system, e.g., a heat pump, having a rather high efficiency, e.g., a Coefficient of Performance (COP) of greater than 1 as it indicates that the heat pump is capable of delivering more heat energy than the energy consumed. Although another form of heating, e.g., via the resistive heating elements, is available, it is imperative that for the most part, heating should be accomplished using the most efficient means possible, e.g., using one or more heat pumps. Therefore, it is important to store energy provided using the most efficient means possible such that the reliance on other sources with much lower efficiency, e.g., heat energy generated using resistive elements, can be reduced. The COP of a heat pump is influenced by various factors, including the temperature difference between the heat source and the heat sink of the heat pump. Therefore, for the most efficient heat transfer to a heat transfer fluid of a thermal battery, the effluent of a thermal battery circulation needs to be disposed at the lowest temperature possible, i.e., effluent that has been substantially thermally spent. For a thermal battery to be useful, there will be circumstances where the thermal battery will need to be charged to anticipate a demand at a later time or where the thermal battery is being charged while simultaneously being discharged when there is a demand for heat. As the operations of a thermal battery may be controlled using cues, e.g., inlet and/or outlet temperature of the heat transfer fluid of the thermal battery and the rate at which discharging (heating) can be accomplished. For instance, a low exit temperature of heat transfer fluid flow indicates that the thermal storage is deleted and must be replenished by continuing to run the charging function of the thermal battery. Therefore, to avoid control failures and to maximize efficiency in heat transfer and retention, these cues must be maintained.

Glycol-based thermal batteries are typically pressurized systems, and there is a potential for leaks to occur. Leakage can result from corrosion, improper installation, or the failure of seals or connections. Glycol leaks not only lead to system inefficiencies but can also pose environmental and safety hazards. Glycol-based thermal batteries may be susceptible to corrosion, particularly if the glycol solution becomes acidic due to degradation or impurities. Corrosion can damage the battery components, including pipes, heat exchangers, or storage tanks, and may result in leaks or system failures. If the glycol-based thermal battery is exposed to low temperatures, there is a risk of the glycol solution freezing. Freezing can cause expansion and damage to the battery's components, including pipes or heat exchangers. Further, thermal fluctuations can cause dimensional changes in the heat transfer components, e.g., coils, etc.

There exists a need for a thermal battery in which charging and discharging of the thermal battery can be performed efficiently and the charging performance is decoupled from the discharging performance. There also exists a need for a thermal battery where the threat of corrosion and negative effects due to dimensional changes of the components of thermal battery are addressed.

SUMMARY OF THE INVENTION

In accordance with the present invention, there is provided a thermal battery including:

(a) a container including an interior space configured for receiving a heat transfer fluid; and (b) a coil disposed in the interior space of the container, the coil including an inlet end and an outlet end, wherein at least one of the inlet end of the coil and the outlet end of the coil is configured to be movably disposed with respect to the container through at least one aperture of the container, wherein one of an expansion and a contraction of the coil is accommodated by allowing movement of the coil relative to the container.

In one embodiment, the thermal battery further includes a grommet configured to be disposed around the at least one aperture to facilitate a relative movement of the coil with respect to the container. In one embodiment, the coil is disposed in a helical configuration including a plurality of coil loops disposed with each two consecutive coil loops separated at an offset of at least about 0.25 inches. In one embodiment, the container is characterized by an upper portion and a lower portion, the upper portion disposed in contacting engagement with a top portion of the heat transfer fluid and the lower portion disposed in contacting engagement with a bottom portion of the heat transfer fluid, the thermal battery further includes an inlet disposed at a first level at the upper portion of the container, the inlet configured for receiving an incoming flow of the heat transfer fluid into the container and an outlet disposed at a second level at the lower portion of the container, the outlet configured for allowing an outgoing flow of the heat transfer fluid out of the container. In one embodiment, the coil further includes an upper portion and a lower portion, the coil is disposed in the container such that the lower portion of the coil is above the second level. In one embodiment, the coil further includes an upper portion and a lower portion, the coil is disposed in the container such that the upper portion of the coil is below the first level. In one embodiment, the container includes an inner wall, the coil is disposed in a helical configuration including a plurality of coil loops, each of the plurality of coils is disposed at a minimum distance of about 0.75 inches from the inner wall. In one embodiment, the container is constructed from a polymeric material.

In accordance with the present invention, there is further provided a thermal battery including:

(a) a container including an interior space configured for receiving a heat transfer fluid, the container is characterized by an upper portion and a lower portion, the upper portion disposed in contacting engagement with a top portion of the heat transfer fluid and the lower portion disposed in contacting engagement with a bottom portion of the heat transfer fluid, the thermal battery further includes an inlet disposed at a first level at the upper portion of the container, the inlet configured for receiving an incoming flow of the heat transfer fluid into the container and an outlet disposed at a second level at the lower portion of the container, the outlet configured for allowing an outgoing flow of the heat transfer fluid out of the container; and (b) a coil disposed in the interior space of the container, the coil including an upper portion and a lower portion, wherein the coil is disposed in the container such that the lower portion of the coil is above the second level and the upper portion of the coil is below the first level.

In accordance with the present invention, there is further a thermal battery including:

(a) a container including an inner wall and an interior space configured for receiving a heat transfer fluid; and (b) a coil disposed in the interior space of the container, the coil is disposed in a helical configuration including a plurality of coil loops disposed with each two consecutive coil loops separated at an offset of at least about 0.25 inches and each of the plurality of coils is disposed at a minimum distance of about 0.75 inches from the inner wall.

An object of the present invention is to provide a thermal battery configured in a manner to allow effective thermal charging to occur.

Another object of the present invention is to provide a thermal battery configured in a manner to allow effective thermal charging to occur while allowing thermal discharging to occur effectively concurrently or separately.

Another object of the present invention is to provide a thermal battery having components that can alleviate the effects of temperature fluctuations and corrosion.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

2—thermal battery
4—container
6—discharging conductor, e.g., heat exchanger coil
8—coil inlet
10—coil outlet
12—coil loop
14—offset
16—upper portion of coil
18—lower portion of coil
20—container inlet
22—container outlet
24—upper offset from first level
26—lower offset from second level
28—gap between coil and side of container
30—thermal storage medium or heat transfer fluid
32—grommet
34—pump
36—charging circuit, e.g., heat supply loop
38—heat pump
40—heat exchanger
42—first level
44—second level
46—band
48—post
50—flow to be heated, e.g., domestic cold water flow
52—heated flow, e.g., domestic hot water flow
54—aperture
56—tip of container inlet
58—coil lumen

PARTICULAR ADVANTAGES OF THE INVENTION

The present thermal battery includes a coil disposed in a manner to optimize heat transfer into the thermal battery by minimally affecting the stratification of the heat transfer fluid within the thermal battery. This is accomplished by disposing the bottom of the coil away from the heat transfer fluid surrounding the exit of the heat transfer fluid to leave the effluent from the exit at as low a temperature as possible. Incoming fluid in the coil through a bottom portion of the thermal battery can be disposed at a temperature higher than the heat transfer fluid at the bottom of the thermal battery causing a heat loss to the heat transfer fluid, increasing its temperature, causing a subsequent heat transfer to the effluent heat transfer fluid less efficient. The top of the coil is disposed below the level at which the heat transfer fluid enters the thermal battery to leave some heat transfer fluid to hold some thermal energy that is not immediately drawn to heat a flow within the coil.

The present thermal battery includes a coil having coil loops arranged with gaps or offset between consecutive coil loops to ensure optimal heat transfer between the heat transfer fluid the fluid disposed through the coil via the entire surface of the coil as there are no coil loops that come in contact with one another reducing the surface area of the coil for heat transfer.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

Figure 1:
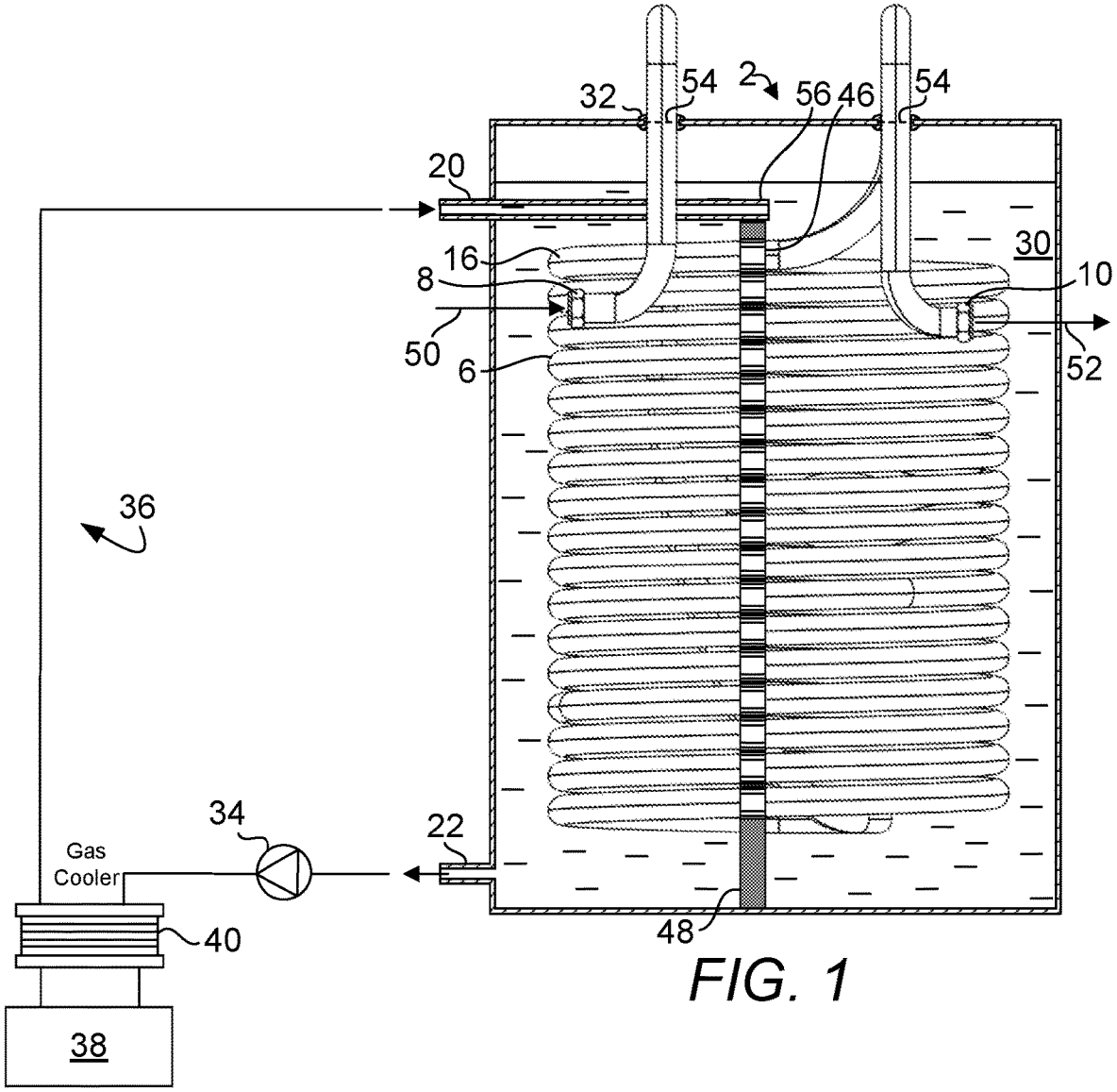
FIG. 1 is a side view of a thermal battery depicting a means for external circulation of the contents of the thermal battery which stores thermal energy in the thermal battery.
Figure 2:
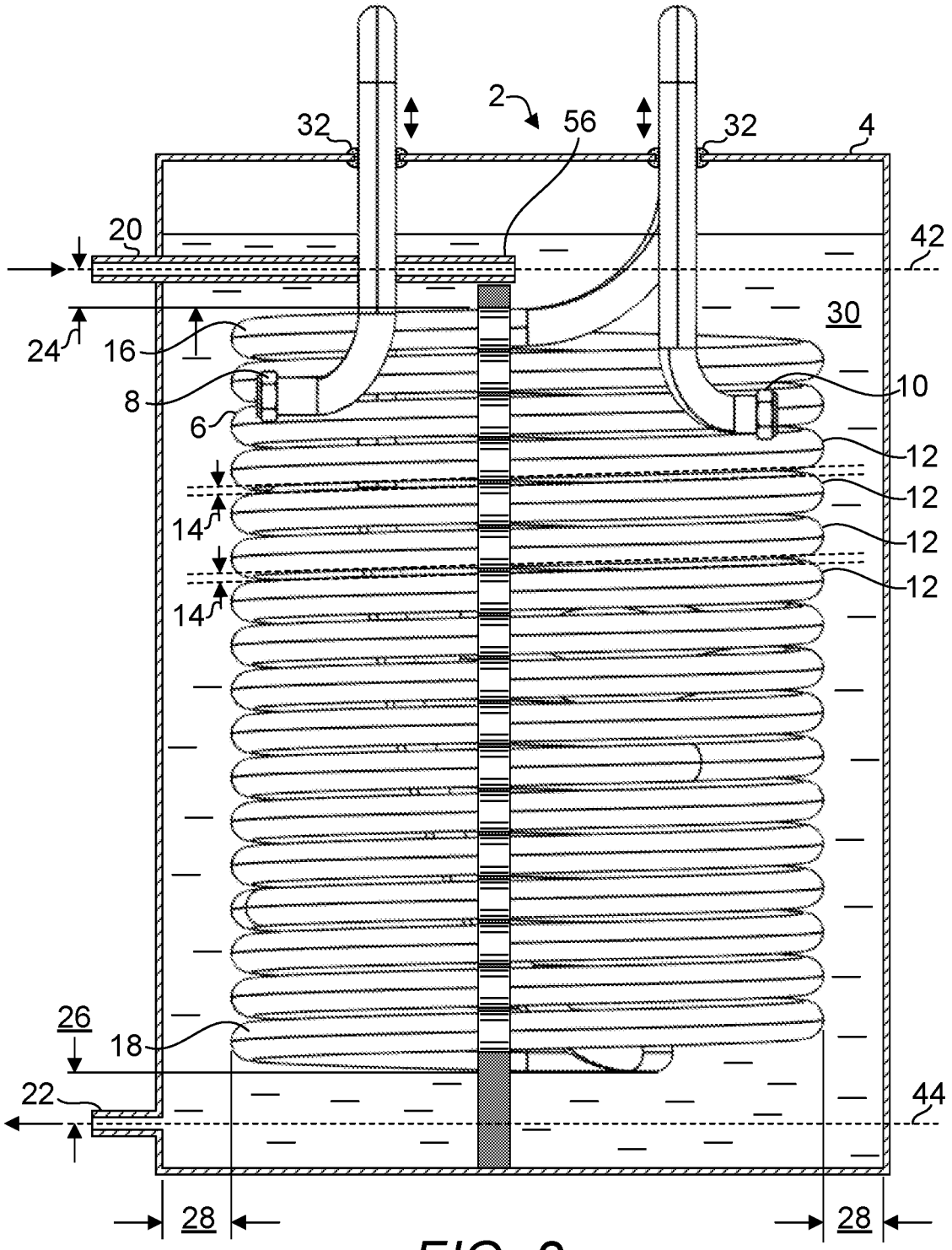
FIG. 2 is a side view of the thermal battery of FIG. 1, depicting a relative position of a coil of the thermal battery with respect to the container of the thermal battery within which the coil is disposed.
Figure 3:
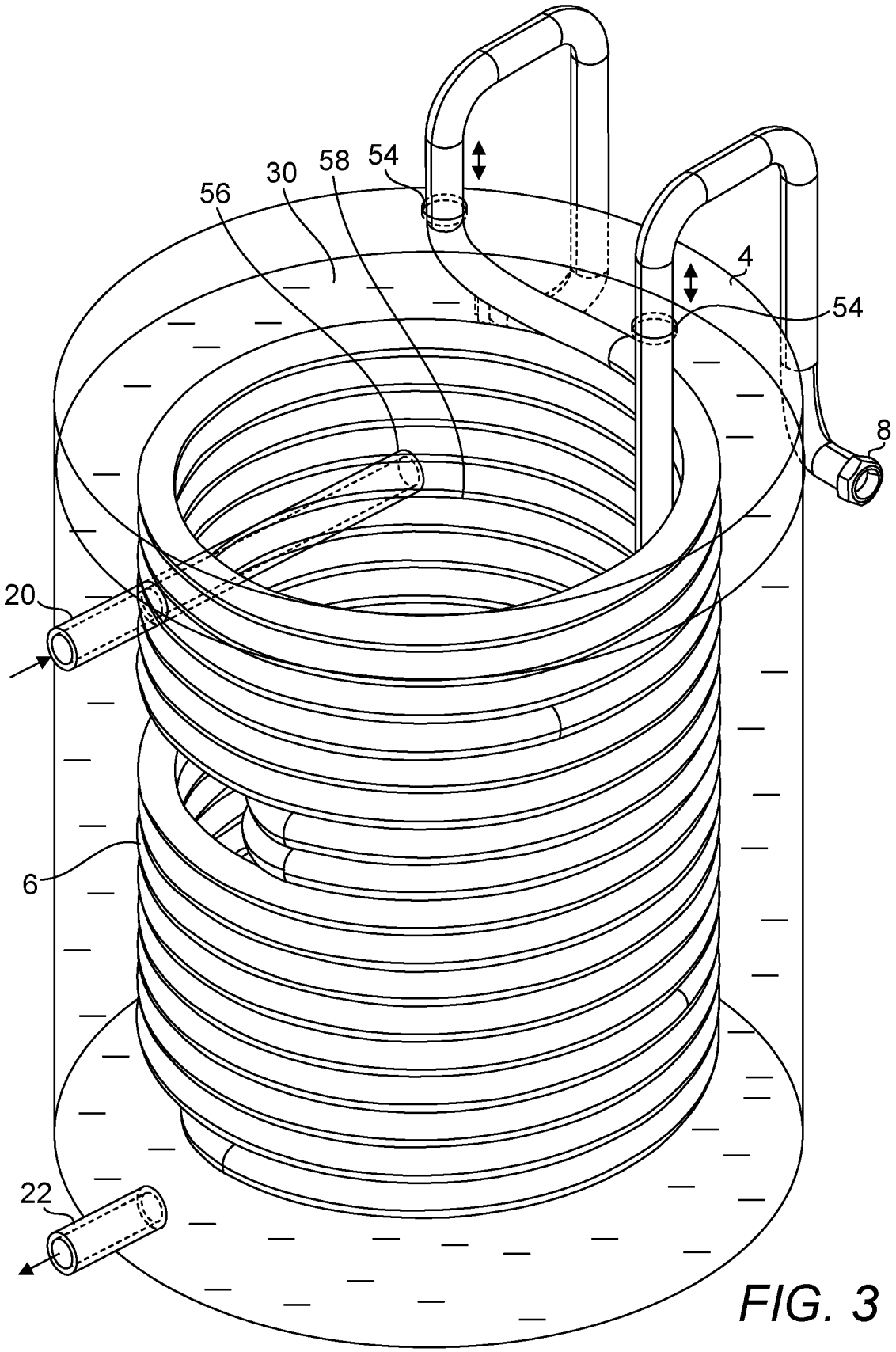
FIG. 3 is a top perspective view of a thermal battery depicting a relative position of a coil of the thermal battery with respect to the container of the thermal battery within which the coil is disposed.

FIG. 1 is a side view of a thermal battery 2 depicting a means for external circulation of the contents 30 of the thermal battery which stores thermal energy in the thermal battery. FIG. 2 is a side view of the thermal battery of FIG. 1, depicting a relative position of a coil of the thermal battery with respect to the container 4, e.g., a 60-gallon container, of the thermal battery within which the coil 6 is disposed. FIG. 3 is a top perspective view of a thermal battery 2 depicting a relative position of a coil 6, e.g., a 6-gallon coil, of the thermal battery with respect to the container of the thermal battery within which the coil 6 is disposed. For simplicity, only a charging circuit 36 and a discharging coil 6 are shown. The charging circuit is essentially a circulation flow loop of the contents 30, e.g., a heat transfer medium, out of the thermal battery, aided by a pump 34, to harness thermal energy using a heat exchanger 40 coupled, e.g., to a heat pump 38, to be returned and stored in the thermal battery. The discharging coil is essentially a conductor configured to carry a fluid flow to be heated by the thermal energy stored in the heat transfer medium 30 with or without the charging circuit loop active at the same time. A charging circuit is useful for harnessing heat energy outside of the thermal battery and disposing or storing the heat energy in the contents 30, e.g., a glycol-water mixture in the container 4. Other modes of heating, e.g., via one or more electric resistive elements or solar heaters, etc., although they are not shown. Other features are also possible, e.g., a valve allowing the thermal battery to be disposed at atmospheric pressure and various mechanisms useful for determining and ascertaining the level of the contents of thermal battery, etc. Shown herein is a thermal battery 2 including a container 4 and a discharging conductor, e.g., coil 6. The container 4 includes an interior space configured for receiving a heat transfer fluid 30. The coil 6 is disposed in the interior space of the container 4 and includes an inlet end and an outlet end. In the embodiment shown, at least one of the inlet end of the coil and the outlet end of the coil is configured to be movably disposed with respect to the container through at least one aperture 54 of the container. For favorable heat transfer, the coil 6 is preferably constructed from a highly heat conductive material, e.g., metal, e.g., steel, copper or aluminum. In one embodiment, the coil 6 is a corrugated stainless steel coil.

In use, the coil 6 can experience temperature fluctuations which make it dimensionally unstable. Therefore, if the coil 6 is fixedly secured at both ends of the coil 6, an expansion or a contraction of the coil 6, experienced as an elongation/shortening of the coil or enlargement/contraction of the coil can put increased stresses in the coil. The coil 6 is preferably not fixedly supported at least at one end of the coil to alleviate stresses which could build due to the temperature fluctuations of the coil. Here, both ends of the coil 6 are shown to be supported only by friction to allow relative movements of each end of the coil 6 to avoid any stress build-up in the coil due to dimensional changes of the coil. In the embodiment shown, grommets 32 are disposed around the apertures 54 to facilitate a relative movement of the coil with respect to the container 4 while ensuring a secure and snug fit of the coil ends through the container 4. In discharging the thermal battery 2, a fluid flow 50, e.g., a domestic water flow, to be heated is received at the coil inlet 8 and heated while it continues through the coil 6 before exiting at the coil outlet 10 to be a heated flow 52.

The coil 6 is disposed in a helical configuration including a plurality of coil loops 12 disposed with each two consecutive coil loops 12 separated at an offset 14 of at least about 0.25 inches. This offset is important in that it allows heat transfer between the coil 6 to be effectively and uninhibitedly maintained across the surface area along the entire length of the coil. The container 4 is characterized by an upper portion and a lower portion, the upper portion disposed in contacting engagement with a top portion of the heat transfer fluid 30 and the lower portion disposed in contacting engagement with a bottom portion of the heat transfer fluid 30, the thermal battery 2 further includes an inlet 20 disposed at a first level 42 at the upper portion of the container where the inlet 20 is configured for receiving an incoming flow of the heat transfer fluid 30 into the container 4. In the embodiment shown, the container inlet 20 extends to a tip 56 disposed substantially centrally with respect to the lumen 58 of the coil 6 such that a return thermal storage medium 30 can be mixed more thoroughly with the thermal storage medium 30 already in the container 4. An outlet 22 is disposed at a second level at the lower portion of the container 4 where the outlet is configured for allowing an outgoing flow of the heat transfer fluid 30 out of the container 4. The coil further includes an upper portion 16 and a lower portion 18, the coil 6 is disposed in the container 4 such that the lower portion 18 of the coil is above the second level 44, i.e., the level at which the charging circuit 36 exits the thermal battery. The heat transfer fluid 30 as disposed within the container 4, forms a stratified column due to temperature, i.e., the top potion of the heat transfer fluid 30 naturally assumes a higher temperature than the bottom portion of the heat transfer fluid 30 in the container 4. These distinct layers are formed based on temperature differences. The bottom layer is most devoid of thermal energy and disposed at the lowest temperature and it is suitable to be aligned with the outlet 22 where the heat transfer fluid 30 is circulated outside of the container 4 to harness thermal energy to be returned and stored in the tank through the inlet 20. By disposing the coil 6 away from this layer, a positive thermal influence of the coil 6 on this layer can be avoided. In one example, the lower offset 26 from the second level is about 2 inches. The coil 6 further includes an upper portion and a lower portion and the coil 6 is disposed in the container 4 such that the upper portion of the coil 6 is below the first level 42, the level at which the charging circuit 36 returns to the thermal battery. By disposing the upper portion of the coil below the first level 42 while the surface of the heat transfer fluid 30 protrudes beyond the first level 42, a top layer of the heat transfer fluid 30 is capable of storing some thermal energy before the layers below it which surrounds the coil 6 continues to be depleted of thermal energy once the discharging conductor becomes active with the fluid flow therein. The thermal reserve in the layer above the coil 6 provides some buffer in thermal reserve before charging can start catching up with the thermal demand caused by the fluid flow in the coil 6, making for a smoother transition from a ramp-up in the charging circuit as the ramp up in thermal charging rate of the charging circuit 36 can take some time to achieve its steady state. In one example, the upper offset 24 from the first level 42 is about 1 inch.

In the embodiment shown, the coil loops 12 are disposed at a minimum distance 28 of about 0.25 inches from the inner wall to stay sufficiently submerged within the core of the heat transfer fluid 30 which has not experienced heat loss to the surroundings of the container 4, ensuring that heat transfer from the heat transfer fluid 30 to the fluid flow in the coil occurs at the largest possible temperature gradient for the highest possible heat transfer rate. In one embodiment, the container is constructed from a polymeric material to act as a poor thermal conductor to reduce heat loss and improve thermal containment within the container 4 while providing resistance to corrosion due to a degraded glycol-water mixture which has become acidic.

Figure 4:
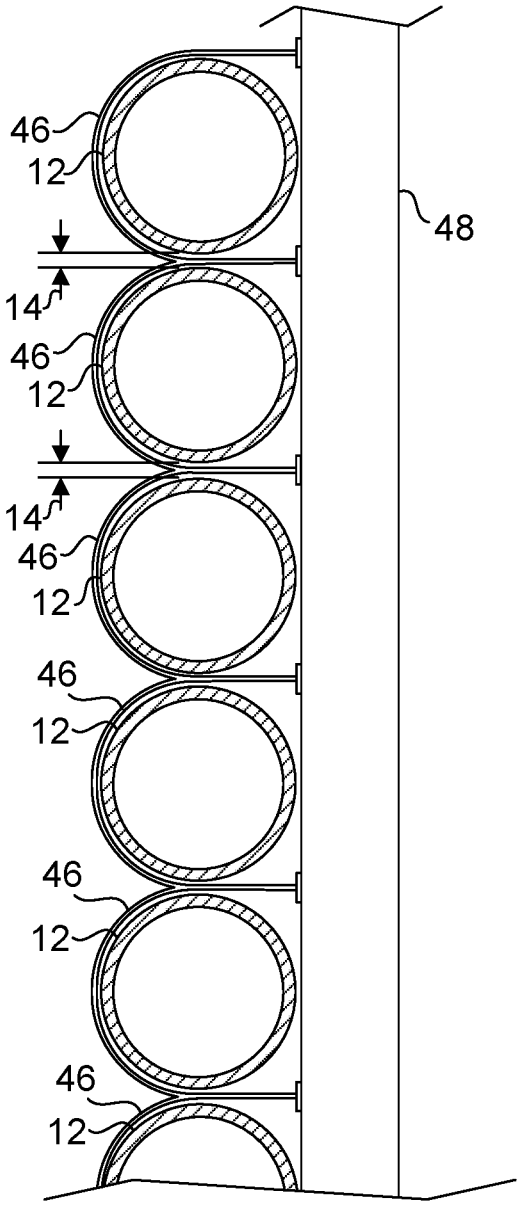
FIG. 4 is a partial cross-sectional view of a coil, depicting a manner in which the consecutive coil loops are secured to maintain offsets between them.

FIG. 4 is a partial cross-sectional view of a coil, depicting a manner in which the consecutive coil loops 12 are secured to maintain offsets 14 between them. Each coil loop 12 is secured with at least a band 46 configured to substantially wrap around the perimeter of the cross-sectional area of a coil loop 12 and secured to a post 48. Referring back to FIG. 1, only one set of a post 48 and a plurality of bands 46 secured thereon is shown although additional sets may be used to secure other parts of the coil as well to ensure that the coil 6 is securely positioned in the container 4 such that the offsets can be better maintained.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. A thermal battery comprising:

(a) a container comprising an interior space configured for receiving a heat transfer fluid;

(b) a coil comprising an inlet end, an outlet end and a plurality of coil loops, said coil disposed in a helical configuration in the interior space of said container, said coil comprising an inlet end and an outlet end, wherein said inlet end of said coil and said outlet end of said coil are configured to each be movably disposed with respect to said container through at least one aperture of said container; and (c) at least one set of support assembly comprising a post and a plurality of bands, each band defining a ring in cooperation with the post and configured to engage and support a respective one of the plurality of coil loops so as to maintain a spaced relationship between adjacent coil loops of the plurality of coil loops, wherein one of a thermal expansion and contraction of said coil is accommodated by allowing movement of said inlet and outlet ends of said coil through apertures on a top wall of said container while adjacent coil loops of said plurality of coil loops are supported and spaced apart.

2. The thermal battery of claim 1, further comprising a grommet configured to be disposed around said at least one aperture to facilitate a relative movement of said coil with respect to said container.

3. The thermal battery of claim 1, wherein each two consecutive coil loops are configured to be separated at an offset of at least about 0.25 inches.

4. The thermal battery of claim 1, wherein said container is characterized by an upper portion and a lower portion, said upper portion disposed in contacting engagement with a top portion of the heat transfer fluid and said lower portion disposed in contacting engagement with a bottom portion of the heat transfer fluid, said thermal battery further comprises an inlet disposed at a first level at said upper portion of said container, said inlet configured for receiving an incoming flow of the heat transfer fluid into said container and an outlet disposed at a second level at said lower portion of said container, said outlet configured for allowing an outgoing flow of the heat transfer fluid out of said container.

5. The thermal battery of claim 4, wherein said coil further comprises an upper portion and a lower portion, said coil is disposed in said container such that said lower portion of said coil is above said second level.

6. The thermal battery of claim 4, wherein said coil further comprises an upper portion and a lower portion, said coil is disposed in said container such that said upper portion of said coil is below said first level.

7. The thermal battery of claim 1, wherein said container comprises an inner wall and each of said plurality of coils is disposed at a minimum distance of about 0.75 inches from said inner wall.

8. The thermal battery of claim 1, wherein said container is constructed from a polymeric material.

9. A thermal battery comprising:

(a) a container comprising an interior space configured for receiving a heat transfer fluid, said container is characterized by an upper portion and a lower portion, said upper portion disposed in contacting engagement with a top portion of the heat transfer fluid and said lower portion disposed in contacting engagement with a bottom portion of the heat transfer fluid, said thermal battery further comprises an inlet disposed at a first level at said upper portion of said container, said inlet configured for receiving an incoming flow of the heat transfer fluid into said container and an outlet disposed at a second level at said lower portion of said container, said outlet configured for allowing an outgoing flow of the heat transfer fluid out of said container;

(b) a coil comprising an inlet end, an outlet end and a plurality of coil loops, said coil disposed in a helical configuration in the interior space of said container, said coil comprising an upper portion and a lower portion, wherein said coil is disposed in said container such that said lower portion of said coil is above said second level and said upper portion of said coil is below said first level; and (c) at least one set of support assembly comprising a post and a plurality of bands, each band defining a ring in cooperation with the post and configured to engage and support a respective one of the plurality of coil loops so as to maintain a spaced relationship between adjacent coil loops of the plurality of coil loops, wherein one of an expansion and a contraction of said coil is accommodated by allowing movement of said inlet and outlet ends of said coil through apertures on a top wall of said container while adjacent coil loops of said plurality of coil loops are supported and spaced apart.

10. The thermal battery of claim 9, wherein said coil further comprises an inlet end and an outlet end, wherein said inlet end of said coil and said outlet end of said coil are configured to each be movably disposed with respect to said container through at least one aperture of said container and one of an expansion and a contraction of said coil is accommodated by allowing movement of said coil relative to said container.

11. The thermal battery of claim 9, further comprising a grommet configured to be disposed around said at least one aperture to facilitate a relative movement of said coil with respect to said container.

12. The thermal battery of claim 9, wherein each two consecutive coil loops are configured to be separated at an offset of at least about 0.25 inches.

13. The thermal battery of claim 9, wherein said container comprises an inner wall and each of said plurality of coils is disposed at a minimum distance of about 0.75 inches from said inner wall.

14. The thermal battery of claim 9, wherein said container is constructed from a polymeric material.

15. A thermal battery comprising:

(a) a container comprising an inner wall and an interior space configured for receiving a heat transfer fluid;

(b) a coil comprising an inlet end, an outlet end and a plurality of coil loops, said coil disposed in a helical configuration in the interior space of said container, said coil is disposed in a helical configuration comprising a plurality of coil loops disposed with each two consecutive coil loops separated at an offset of at least about 0.25 inches and each of said plurality of coils is disposed at a minimum distance of about 0.75 inches from said inner wall; and (c) at least one set of support assembly comprising a post and a plurality of bands, each band defining a ring in cooperation with the post and configured to engage and support a respective one of the plurality of coil loops so as to maintain a spaced relationship between adjacent coil loops of the plurality of coil loops, wherein one of an expansion and a contraction of said coil is accommodated by allowing movement of said inlet and outlet ends of said coil through apertures on a top wall of said container while adjacent coil loops of said plurality of coil loops are supported and spaced apart.

16. The thermal battery of claim 15, wherein said coil further comprises an inlet end and an outlet end, wherein at least one of said inlet end of said coil and said outlet end of said coil is configured to be movably disposed with respect to said container through at least one aperture of said container and one of an expansion and a contraction of said coil is accommodated by allowing movement of said coil relative to said container.

17. The thermal battery of claim 16, further comprising a grommet configured to be disposed around said at least one aperture to facilitate a relative movement of said coil with respect to said container.

18. The thermal battery of claim 15, wherein said container is characterized by an upper portion and a lower portion, said upper portion disposed in contacting engagement with a top portion of the heat transfer fluid and said lower portion disposed in contacting engagement with a bottom portion of the heat transfer fluid, said thermal battery further comprises an inlet disposed at a first level at said upper portion of said container, said inlet configured for receiving an incoming flow of the heat transfer fluid into said container and an outlet disposed at a second level at said lower portion of said container, said outlet configured for allowing an outgoing flow of the heat transfer fluid out of said container.

19. The thermal battery of claim 15, wherein said coil further comprises an upper portion and a lower portion, said coil is disposed in said container such that said lower portion of said coil is above said second level.

20. The thermal battery of claim 15, wherein said coil further comprises an upper portion and a lower portion, said coil is disposed in said container such that said upper portion of said coil is below said first level.

* * * * *